United States Patent [19]

Ament et al.

[11] Patent Number: 4,509,478

[45] Date of Patent: Apr. 9, 1985

[54] ENGINE FUEL CONTROL SYSTEM

[75] Inventors: Frank Ament, Rochester; Richard A. Peden, Livonia; John E. Ausen, Flint, all of Mich.

[73] Assignee: General Motors Corporation, Detroit, Mich.

[21] Appl. No.: 619,476

[22] Filed: Jun. 11, 1984

[51] Int. Cl.[3] ..... F02B 32/00

[52] U.S. Cl. ..... 123/339; 123/340; 123/352; 123/370

[58] Field of Search ..... 123/339, 340, 370, 352

[56] References Cited

U.S. PATENT DOCUMENTS

| | | | |
|---|---|---|---|
| 4,203,395 | 5/1980 | Coremas et al. | 123/339 |
| 4,402,289 | 9/1983 | Ikeurn | 123/339 |
| 4,418,665 | 12/1983 | Nagase | 123/339 |
| 4,446,832 | 5/1984 | Matsumura et al. | 123/339 |
| 4,474,154 | 10/1984 | Henning et al. | 123/339 |

*Primary Examiner*—Raymond A. Nelli

*Attorney, Agent, or Firm*—Howard N. Conkey

[57] ABSTRACT

A fuel control system for an internal combustion engine in which the idle fuel quantity is adjusted to maintain a predetermined desired idle speed and in which the transition between the idle fuel quantity and a scheduled off-idle fuel quantity is blended to provide for smooth engine operation.

2 Claims, 7 Drawing Figures

ENGINE FUEL CONTROL SYSTEM

This invention relates to an engine fuel control system and more specifically to a fuel control system for blending the closed loop controlled idle fuel schedule and an off-idle fuel schedule of an engine during the transitions between engine idle and off-idle states.

In control systems for internal combustion engines, it is common to adjust the fuel quantity supplied to the engine in response to engine speed during an idle operating state in order to maintain a desired engine idle speed. When this closed loop idle speed control is combined with the control of the off-idle fuel quantity in response to a predetermined off-idle fuel schedule, a sudden shift in the amount of fuel provided to the engine may occur during the step transition between the idle and off-idle operating states of the engine. For example, during engine idle, closed loop control of the fuel supplied to the engine in order to maintain a predetermined engine idle speed may require an adjustment of the fuel by an amount such that when the engine throttle or accelerator pedal for a diesel engine is opened, the return to the fuel quantity established by the off-idle fuel schedule may result in a sharp decrease in the fuel amount supplied to the engine. This decrease may result in engine stalling and/or surging. Similarly, a transition from the off-idle fuel schedule to the idle fuel schedule may result in a shift in the fuel supplied to the engine, again giving rise to uneven engine operation.

It is the general object of this invention to provide for a fuel control system for an engine that establishes a smooth transition between the idle and off-idle states of the engine.

It is another object of this invention to provide for a fuel control system for an internal combustion engine in which the idle fuel quantity is adjusted to maintain a predetermined desired idle speed and in which the transition between the idle fuel quantity and a predetermined scheduled off-idle fuel quantity is blended to provide for smooth engine operation.

The foregoing and other objects of this invention may be best understood by reference to the following description of a preferred embodiment and the drawings in which.

Figure 1:
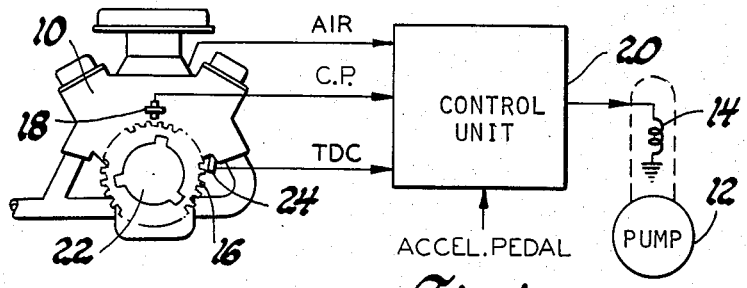
FIG. 1 is an overall schematic diagram of the control system of this invention.

The preferred embodiment of this invention is described with respect to a six-cylinder diesel engine 10 having a fuel pump 12 rotated by the engine for injecting fuel to the individual cylinders. The fuel pump 12 includes a solenoid 14 energized in timed relationship to the engine position so as to control the fuel quantity injected by the pump 12. In this respect, the solenoid winding 14 may be operative to control a spill valve for establishing the injection duration.

The diesel engine 10 includes a ring gear 16 having teeth spaced around its periphery at, for example, 3 degree intervals. An electromagnetic sensor 18 is positioned to sense the teeth on the ring gear as it is rotated by the engine crankshaft to provide crank position pulses (C.P.) to a control unit 20. The crank position pulses are at a frequency directly proportional to engine speed.

A signal representing the top dead center position of each of the cylinders of the engine 10 is provided by a disc member 22 also rotated by the crankshaft having teeth spaced at 120 degree intervals which cooperate with a sensor 24 for providing a top dead center pulse to the control unit 20 at each piston top dead center position.

Additional signals provided to the control unit 20 from the diesel engine 10 include a mass air flow signal provided by a conventional mass air flow sensor in the engine air intake path, and an accelerator pedal position signal. The accelerator pedal position signal represents the position of the operator controlled fuel control element. This signal may be provided by a potentiometer adjusted by the position of the accelerator pedal. The control unit 20 is responsive to the various inputs to control the timed energization of the solenoid winding 14 to in turn control the fuel quantity injected into the engine 10 by the fuel pump 12. The control unit 20 in general provides for closed loop control of the idle speed of the engine 10 to a desired idle speed by adjusting the fuel injected by the pump 12 in response to the sensed idle speed and further provides for an off-idle fuel quantity in accord with a predetermined stored schedule based on various input operating parameters.

Figure 2:
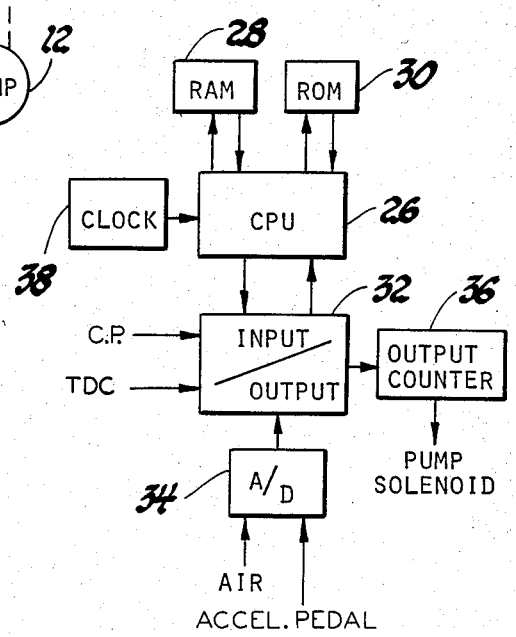
FIG. 2 illustrates a vehicle mounted computer which is a preferred embodiment of the control unit of FIG. 1.

The preferred embodiment of the control unit 20 is a vehicle mounted digital computer which accepts the various input signals and processes them in accord with a predetermined program to energize the solenoid winding 14 so as to provide an established fuel schedule. As seen in FIG. 2, the digital computer basically comprises a central processing unit (CPU) 26 which interfaces in the normal manner with a random access memory (RAM) 28, a read-only memory (ROM) 30, an input/output unit 32, an analog-to-digital converter (A/D) 34, an output counter 36 and a clock 38.

In general, the CPU 26 executes an operating program permanently stored in the ROM 30 which also contains look-up tables addressed in accord with the values of selected parameters as will be described in determining the required fuel quantities to be injected into the engine 10. Data is temporarily stored and retrieved from various ROM designated address locations in the RAM 28. Discrete input signals are sensed and the values of analog signals are determined via the input/output circuit 32 which receives directly the pulse frequency input signals such as the crankshaft position and top dead center signals previously described and the A/D 34 which receives the analog signals from the mass air sensor and accelerator pedal position sensor previously described. The output counter 36 has pulse width values periodically inserted therein in timed relationship to the engine for controlling the solenoid winding 14 to provide the fuel schedules established by the control unit 20.

Figure 4:
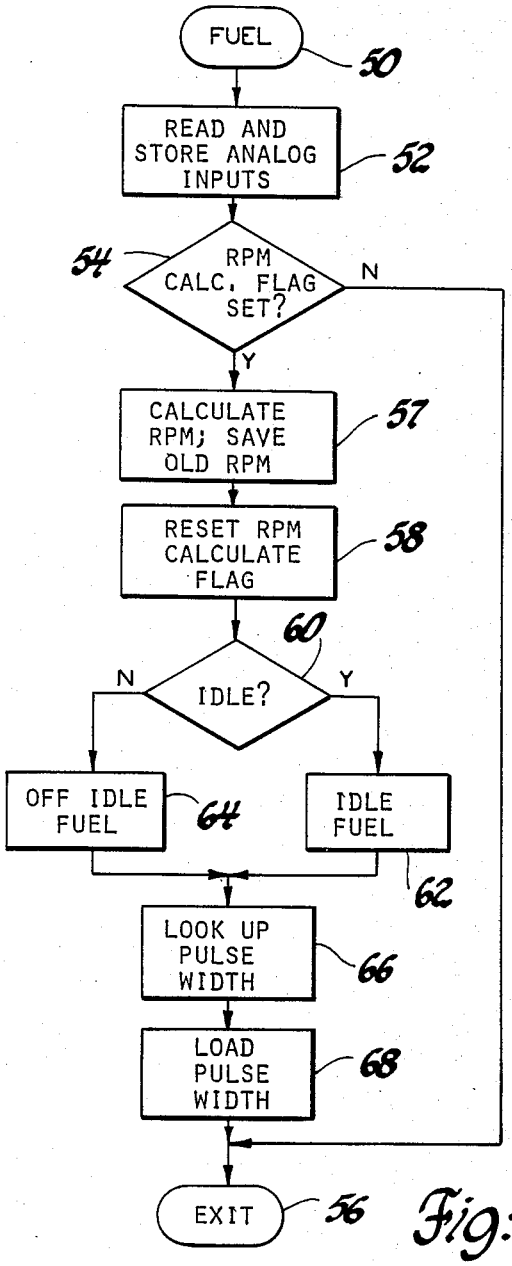
FIGS. 3, 4, 5 and 6 are diagrams illustrative of the operation of the computer of FIG. 2 for controlling the fuel supplied to an internal combustion engine in accord with the principles of this invention.
Figure 5:
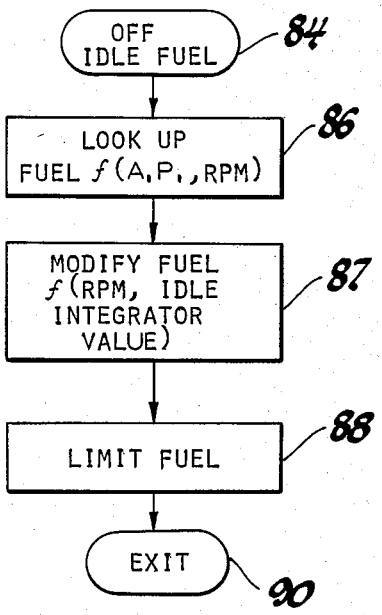
Figure 6:
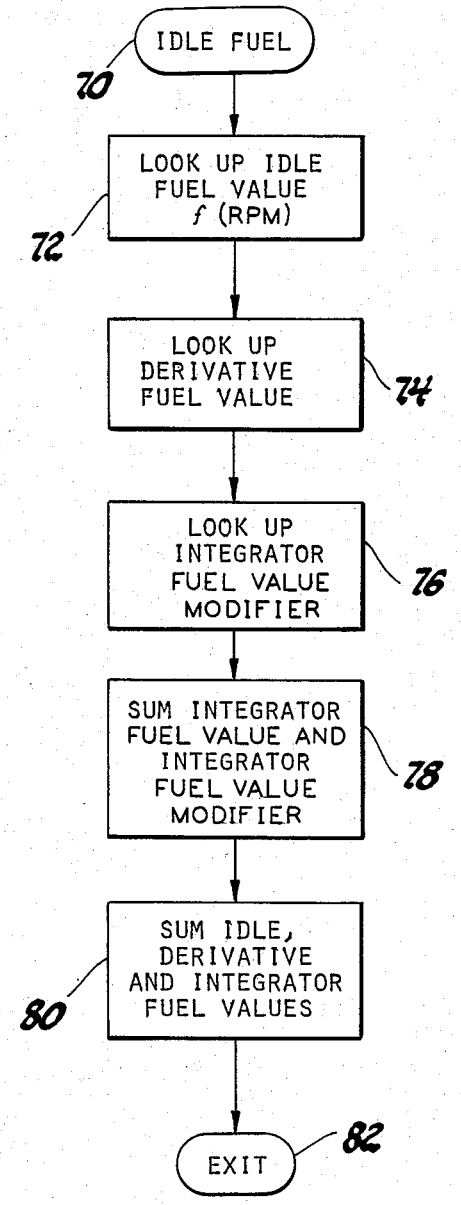

The operation of the digital computer of FIG. 2 in controlling the solenoid winding 14 in response to the various inputs to establish the fuel requirements of the engine are described in FIGS. 3 through 6. In general, the digital computer executes a main loop routine stored in the ROM 30 at repeated timed intervals. For example, the main loop may be executed at 10 millisecond intervals during which various routines may be executed including the fuel control routine of this invention. This routine is illustrated in FIGS. 4 through 6.

While engine speed may be determined by sensing the frequency of the crankshaft position pulses provided by the sensor 18, in the preferred embodiment of this invention the engine speed is determined by timing the period between two predetermined crankshaft positions. For example, in the preferred embodiment, the speed of the engine is determined just prior to each injection event from the time it takes the crankshaft to rotate between 45 and 65 degrees after top dead center. This time is inversely proportional to engine speed and is utilized as a representation of the engine speed in the fuel control routines.

Figure 3:
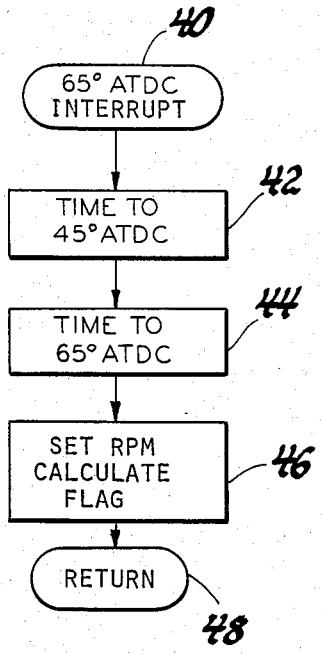

In determining engine speed, the top dead center pulses generated by the sensor 24 and the crankshaft position pulses generated by sensor 18 are utilized to generate a 65 degree after top dead center interrupt input of the CPU 26 which interrupts the main loop previously referred to and executes a routine for establishing engine speed. This routine is illustrated in FIG. 3. Upon receipt of sufficient crankshaft position pulses after the top dead center signal, the CPU 26 interrupts the main loop, enters the 65 degree after top dead center interrupt routine at step 40 and proceeds to a step 42 where the time required for the engine crankshaft to rotate 45 degrees is determined. The angular increment of 45 degrees may be determined by monitoring the number of pulses provided by the crankshaft position sensor 18 after receipt of the top dead center signal. This time increment is measured utilizing clock 38 and is then stored in a ROM designated memory location in the RAM 28. Thereafter at step 44, the time required for the crankshaft to rotate through an angle of 65 degrees after top dead center is determined. Again, the angular increment is determined by monitoring the number of teeth sensed by the sensor 18 after receipt of the top dead center pulse. This time measured for this angle interval is also stored in a ROM designated memory location in the RAM 28. Next, the 65 degree after top dead center interrupt routine proceeds to step 46 where an rpm calculate flag in the CPU 26 is set. At step 48, the program returns to the main loop.

Referring to FIG. 4, the portion of the main loop which determines and controls the fuel injected by the injection pump 12 is illustrated. This portion of the main loop is entered at step 50 and proceeds to a step 52 where the analog inputs to the analog-to-digital converter 34 are sequentially read and stored in ROM designated memory locations in the RAM 28. Thereafter, the program proceeds to a decision point 54 where the rpm calculate flag in the CPU 26 is sampled. If this flag is in a reset condition indicating that the 65 degree after top dead center interrupt routine for measuring engine speed has not been executed since the last execution of the main loop, the program exits the fuel control routine portion at step 56. However, if at step 54 it is sensed that the rpm calculate flag is set indicating that the 65 degree after top dead center interrupt routine of FIG. 3 had been executed during which the rpm calculate flag was set at step 46, the program proceeds to a step 57 where the previously determined time interval values are saved in ROM designated RAM memory locations and a new value of engine speed is calculated based on the difference between the two timed intervals determined in the 65 degree after top dead center interrupt routine of FIG. 3.

Following the calculation of the new engine speed at step 57, the program proceeds to a step 58 where the rpm calculate flag in the CPU 26 is reset. During subsequent executions of the main loop, the fuel control routine will be bypassed by proceeding from decision point 54 to the exit point 56 of the fuel control routine until the next 65 degree after top dead center signal and crankshaft position signals are provided to the control unit 20 to again initiate the 65 degree after top dead center interrupt routine of FIG. 3.

From the step 58, the program proceeds to a decision point 60 where it is determined whether or not the engine is operating in an idle or off-idle state. This operating state is determined by the condition of the accelerator pedal position read and stored at step 52. If the accelerator pedal position is below a predetermined value indicating the engine in operating at idle, the program proceeds to a step 62 where an idle fuel routine is executed to determine the idle fuel quantity to be injected. As will be described, this routine provides for adjustment of the injected fuel quantity to attain a predetermined engine idle speed.

If at decision point 60 it is determined that the accelerator pedal position is representative of an off-idle engine operating condition, the program proceeds to a step 64 where an off-idle fuel routine is executed wherein the off-idle fuel quantities injected by the injection pump 12 are determined.

From each of the steps 62 and 64, the program proceeds to a step 66 where the required pulse width or energization time of the solenoid winding 14 to cause the pump 12 to inject the required fuel amount is determined. This pulse width is obtained from a three-dimensional look-up table in the ROM 30 which contains a schedule of pulse width values selected as a function of the desired fuel quantity and the engine speed. At step 68, the determined pulse width is loaded into the output counter 36 to control the energization of the solenoid winding 14 to provide for the injection of the required amount of fuel to the diesel engine 10 by the injection pump 12.

The idle fuel routine 62 of FIG. 4 is illustrated in detail in FIG. 6. Referring to this FIGURE, the idle fuel routine is entered at step 70 and proceeds to a step 72 where an idle fuel value is obtained from a look-up table in the ROM 30 addressed by the value of engine speed determined at step 57. In general, the idle fuel schedule stored in the ROM 30 has a negative slope so that the engine speed is maintained at a value generally determined by its load and the slope of the idle fuel schedule.

From step 72, the program proceeds to a step 74 where a derivative fuel value is obtained from a look-up table in the ROM 30. This derivative fuel value is based on the difference between the old value of engine speed saved at step 57 and the new value of engine speed determined at step 57.

From step 74, the program proceeds to a step 76 where an integrator fuel value modifier is obtained from a look-up table in the ROM 30. This integrator fuel value modifier is based on the magnitude of the difference between the new engine speed determined at step 57 and a desired engine idle speed and establishes the gain of the integral term in the closed loop control of idle speed. For example, if the desired and measured engine speed are equal, the integrator fuel value modifier will be zero so that the fuel quantity being supplied to the engine will not be varied by the integral term.

However, if the measured engine speed deviates from the desired engine speed, the amount of change in integrator fuel value is based on the magnitude of the difference. From step 76, the program proceeds to a step 78 where the previous value of the integral fuel value and the integrator fuel value modifier established at step 76 are summed to establish a new integrator fuel value.

At step 80, the newly determined integrator fuel value and the derivative fuel value are summed with the idle fuel value determined from the look-up table at step 72. This sum stored in the RAM 28 in a fuel quantity memory location. From step 80, the program exits the idle fuel control routine at step 82. Subsequently at step 66 the program determines the required pulse width to establish the fuel quantity value stored in the fuel quantity memory location in the RAM 28 and loads the determined fuel pulse width into the output counter 36 at step 68 to provide the scheduled idle fuel quantity. As long as the engine is at idle, the idle control routine of FIG. 6 is repeatedly executed to continually update the scheduled fuel quantity stored in the RAM 28. As long as the measured engine speed deviates from the desired engine speed, the integrator fuel value established by steps 76 and 78 continually is changed to adjust the scheduled fuel quantity until the measured engine speed is brought into correspondence with the desired engine idle speed.

The magnitude of the integral fuel value established at step 78 to produce the desired engine idle speed varies in accord with the engine load conditions. For example, if the engine is idling while the transmission of the vehicle is in drive, a larger integral fuel value may be required in order to maintain the desired engine idle speed. If the transmission is then placed in neutral, the integral fuel value may be decreased during repeated executions of the idle fuel routine 62 to maintain the desired engine idle speed.

The off-idle fuel quantity established in the off-idle fuel routine 64 is determined by a predetermined schedule as will be described. Due to the fact that the off-idle and idle fuel quantities are established by separate table values and that the idle fuel quantity is further modified in accord with the integral term in the idle fuel control routine of FIG. 6 as previously described, when the engine accelerator pedal is varied between idle and off-idle conditions a sudden shift in the fuel quantity supplied to the engine 10 may result. For example, assuming the engine 10 is under a particular load level as a result of the transmission being in drive, the integral value established during the idle control routine of FIG. 6 may increase the idle fuel quantity above the scheduled quantity in order to maintain the desired engine idle speed. Thereafter, when the accelerator pedal is moved away from the idle position, if the off-idle fuel quantity scheduled is less than the adjusted idle fuel quantity, a sudden decrease in the fuel supplied to the engine may result. The severity of this decrease may be such as to produce undesirable engine surging or perhaps an engine stall. Similarly, if the adjusted idle fuel quantity were less than the scheduled off-idle fuel quantity, as the accelerator pedal is move away from the idle position the sudden shift in the increasing fuel direction may produce undesirable engine surging.

In accord with this invention, the off-idle fuel control routine provides for a blending between the adjusted idle and the off-idle fuel quantity schedules to prevent the sudden changes in the injected fuel quantity that otherwise may result in the transition between the idle and off-idle operating states of the engine. Referring to FIG. 5, the off-idle fuel control routine 64 is illustrated. This routine is entered at step 84 and then proceeds to a step 86 where the off-idle fuel quantity is determined from a three-dimensional look-up table in the ROM 30 containing an off-idle fuel schedule as a function of engine speed and accelerator pedal position. The look-up table is addressed by the engine speed determined at step 57 and the accelerator pedal position stored at step 52. The fuel quantity retrieved from memory is then modified at step 87 as a function of the engine speed and the idle integrator fuel value established during the idle control routine of FIG. 6 to provide a smooth transition between the idle and off-idle operating states.

Figure 7:
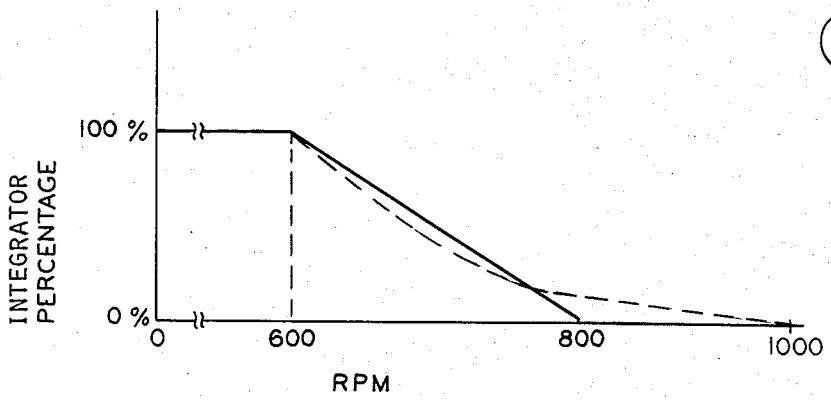
FIG. 7 is a curve of the integrator percentage factor used to blend the idle and off-idle fuel quantities.

At step 87, the scheduled off-idle fuel quantity determined at step 86 is adjusted by a fraction or percentage of the idle integrator fuel adjustment value, the percentage varying between 0% and 100% and being dependent upon the engine speed value within a range of speeds in proximity to engine idle which, in one embodiment, may be 600 rpm. The percentage of the prior integrator fuel value summed with the off-idle fuel value varies inversely, but not necessarily linearly, with engine speed between 0% an 100% over the specified speed range that is in proximity to the desired idle speed. A schedule of the percentage value as a function of engine speed in one embodiment is illustrated in the solid line curve of FIG. 7. In this example, the percentage varies between 100% at 600 rpm or less and 0% at 800 rpm or more. With this schedule, as the engine speed decreases from 800 rpm during an off-idle engine operating state, the scheduled off-idle fuel value is progressively adjusted in direction depending on the sign of the integrator fuel value until the engine speed reaches 600 rpm at which time the whole value of the prior idle integrator fuel value has been summed with the scheduled off-idle fuel value. Conversely, as the engine speed increased above 600 rpm during an off-idle engine operating state, the off-idle fuel adjustment decreases from the value of the integrator fuel value until the engine speed reaches 800 rpm at which time no adjustment is made to the scheduled off-idle fuel value. The broken line curve of FIG. 7 illustrates the schedule of the percentage value in another embodiment of the invention.

The effect of the step 87 is to provide a smooth, blended transition between the idle and off-idle operating states of the engine 10 and thereby avoid sudden shifts in the fuel quantities injected into the engine.

Again referring to FIG. 5, the program next proceeds to a step 88 where a fuel limit routine is executed to limit the maximum fuel quantity to be injected to the engine in the well-known manner to inhibit the generation of the undesirable exhaust components. From step 88, the program exits the off-idle fuel control routine at step 90.

The foregoing description of a preferred embodiment of the invention for the purpose of illustrating the invention is not to be considered as limiting or restricting the invention since many modifications may be made by the exercise of skill in the art without departing from the scope of the invention.

The embodiments of the invention in which an exclusive property or privilege is claimed are defined as follows:

1. A fuel control system for an internal combustion engine having a fuel delivery means for supplying fuel to the engine, the fuel control system comprising:

means for sensing the idle and off-idle operating states of the engine;

means for sensing the engine speed;

means for scheduling an off-idle fuel quantity in accord with predetermined engine operating parameters during the off-idle operating state of the engine;

means for scheduling an idle fuel quantity in accord with the engine speed during the idle operating state of the engine;

means for controlling the fuel delivery means to supply the scheduled idle and off-idle fuel quantities during the respective idle and off-idle operating states of the engine;

means responsive to the sensed engine speed during the idle operating state of the engine for adjusting the scheduled idle fuel quantity by an amount to obtain a desired engine idle speed; and means for progressively adjusting the scheduled off-idle fuel quantity between 0 and 100 percent of the prior idle fuel adjustment amount in an inverse relationship to engine speed over a predetermined speed range in proximity to the desired engine idle speed, whereby the progressive variation in the off-idle fuel quantity value provides a smooth transition between the idle and off-idle operating states of the engine.

2. A fuel control system for an internal combustion engine having a fuel delivery means for supplying fuel to the engine, the fuel control system comprising:

means for sensing the idle and off-idle operating states of the engine;

means for sensing the engine speed;

means for scheduling an off-idle fuel quantity in accord with predetermined engine operating parameters during the off-idle operating state of the engine;

means for scheduling an idle fuel quantity in accord with the engine speed during the idle operating state of the engine;

means for integrating the difference between the sensed engine speed and a desired engine idle speed to generate an integrator fuel value;

means for summing the scheduled idle fuel quantity and the integrator fuel quantity;

means for controlling the fuel delivery means to supply the scheduled off-idle fuel quantities during the off-idle operating state of the engine and to supply the summed scheduled idle fuel quantity and the integrator fuel quantity during the idle operating state of the engine;

means for progressively adjusting the scheduled off-idle fuel quantity between 0 and 100 percent of the integrator fuel quantity in an inverse relationship to engine speed over a predetermined speed range in proximity to the desired engine idle speed, whereby the progressive variation in the off-idle fuel quantity value provides a smooth transition between the idle and off-idle operating states of the engine.

* * * * *